US007992977B2

(12) United States Patent
Mano

(10) Patent No.: US 7,992,977 B2
(45) Date of Patent: Aug. 9, 2011

(54) LIQUID EJECTING APPARATUS AND LIQUID SUPPLY METHOD

(75) Inventor: Takashi Mano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 602 days.

(21) Appl. No.: 12/050,531

(22) Filed: Mar. 18, 2008

(65) Prior Publication Data

US 2008/0231672 A1 Sep. 25, 2008

(51) Int. Cl.
*B41J 2/175* (2006.01)

(52) U.S. Cl. ..... 347/85; 347/86

(58) Field of Classification Search ..... 347/85–87
See application file for complete search history.

(56) References Cited

U.S. PATENT DOCUMENTS 7,029,103 B2 * 4/2006 Iida ..... 347/86
7,559,634 B2 * 7/2009 Miyazawa ..... 347/84
7,794,067 B2 * 9/2010 Miyazawa et al. ..... 347/85
7,815,298 B2 * 10/2010 Miyazawa et al. ..... 347/86
2004/0056936 A1 * 3/2004 Usui et al. ..... 347/86
2008/0079790 A1 * 4/2008 Kachi ..... 347/87

FOREIGN PATENT DOCUMENTS

JP 2001-212971 8/2001
JP 2007-050666 3/2007

* cited by examiner

*Primary Examiner* — Ellen Kim

(74) *Attorney, Agent, or Firm* — Maschoff Gilmore & Israelsen

(57) ABSTRACT

A liquid ejecting apparatus which includes an ejection head capable of ejecting a liquid to an ejection object, a liquid source including a liquid container capable of containing the liquid, a flow channel capable of allowing the liquid to flow form the liquid source to the ejection head, and a pressure buffer disposed in the flow channel capable of buffering a variation in pressure of the liquid in the flow channel when the liquid container is detached from the liquid source.

10 Claims, 9 Drawing Sheets

LIQUID EJECTING APPARATUS AND LIQUID SUPPLY METHOD

The entire disclosure of Japanese Patent Application No. 2007-072014, filed Mar. 20, 2007 is expressly incorporated herein by reference.

BACKGROUND OF THE INVENTION

1. Technical Field

The present invention relates to a liquid ejecting apparatus and a method of supplying liquid to a liquid ejecting apparatus.

2. Related Art

In an ink jet printer, the ink is ejected from a print head and is stored in an ink cartridge which is supplied from the ink cartridge through an ink channel.

Typically, the ink is moved through the ink channel by pressurizing the ink cartridge with a pressurizing pump or the like. In such printers, the pressure of the ink cartridge, the ink channel, and the print head is made to be higher than the atmospheric pressure by pressurizing the areas. Accordingly, when the ink cartridge is detached from a cartridge holder, the ink in the ink channel is extruded from a connection port to the ink cartridge. Unfortunately, however, when the ink is extruded from the connection port, the cartridge holder or printing medium may be contaminated with the ink.

In order to solve the above-mentioned problem, Japanese Patent Application No. JP-A-2001-212971 discloses a method for depressurizing an ink cartridge by placing an atmosphere opening valve between the ink cartridge and a pressurizing pump and opening the atmosphere opening valve before detaching the ink cartridge.

In this configuration, it is necessary to open the atmosphere opening valve before detaching the ink cartridge, thereby making it troublesome to detach the ink cartridge. In addition, it is necessary to provide a portion receiving the extruded ink, thereby causing an increase in cost.

BRIEF DESCRIPTION OF THE INVENTION

An advantage of some aspects of the invention is that it provides a liquid ejecting apparatus and method of supplying liquid to a liquid ejecting apparatus which prevents the ink in a flow channel from being extruded when the liquid container is detached from the flow channel.

One aspect of the invention is a liquid ejecting apparatus including an ejection head capable of ejecting a liquid to an ejection object, a liquid source including a liquid container which is capable of containing the liquid, a flow channel capable of allowing the liquid to flow from the liquid source to the ejection head, and a pressure buffer disposed in the middle of the flow channel which is capable of buffering any variation in pressure in the liquid in the flow channel when the liquid container is detached from the liquid source.

Another aspect of the invention is a liquid ejecting apparatus including an ejection head capable of ejecting a liquid onto an ejection object, a liquid source including a liquid container capable of containing the liquid which is also capable of being attached to and detached from an attachment section, a flow channel communicating with the liquid container which is capable of allowing the liquid to flow from the liquid container toward the ejection head, a volume varying member disposed in the flow channel which is capable of allowing the liquid to flow in the flow channel and varying the inner volume of the flow channel in response to a push member; and a push member capable of initiating the variation in the volume varying member and releasing the variation in the volume in the volume varying member when the liquid container is detached from the attachment section.

A third aspect of the invention is method of supplying a liquid from a detachable liquid container to an ejection head through a flow channel comprising varying the volume in a volume varying member into which the liquid flows when the liquid when the liquid container is detached from the attachment section.

Accordingly, in each of these configurations, the volume varying member can easily vary the volume in which the liquid is contained in order to respond to the change in pressure when the liquid container is detached. Therefore, even when the flow channel is pressurized and the liquid in the flow channel is pressurized, the volume of the volume varying member compensates for the change in pressure, thereby preventing the extrusion of the liquid. As a result, it is possible to prevent the liquid from being extruded and contaminating an ejection object when the liquid container is detached, thereby suppressing an increase in cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
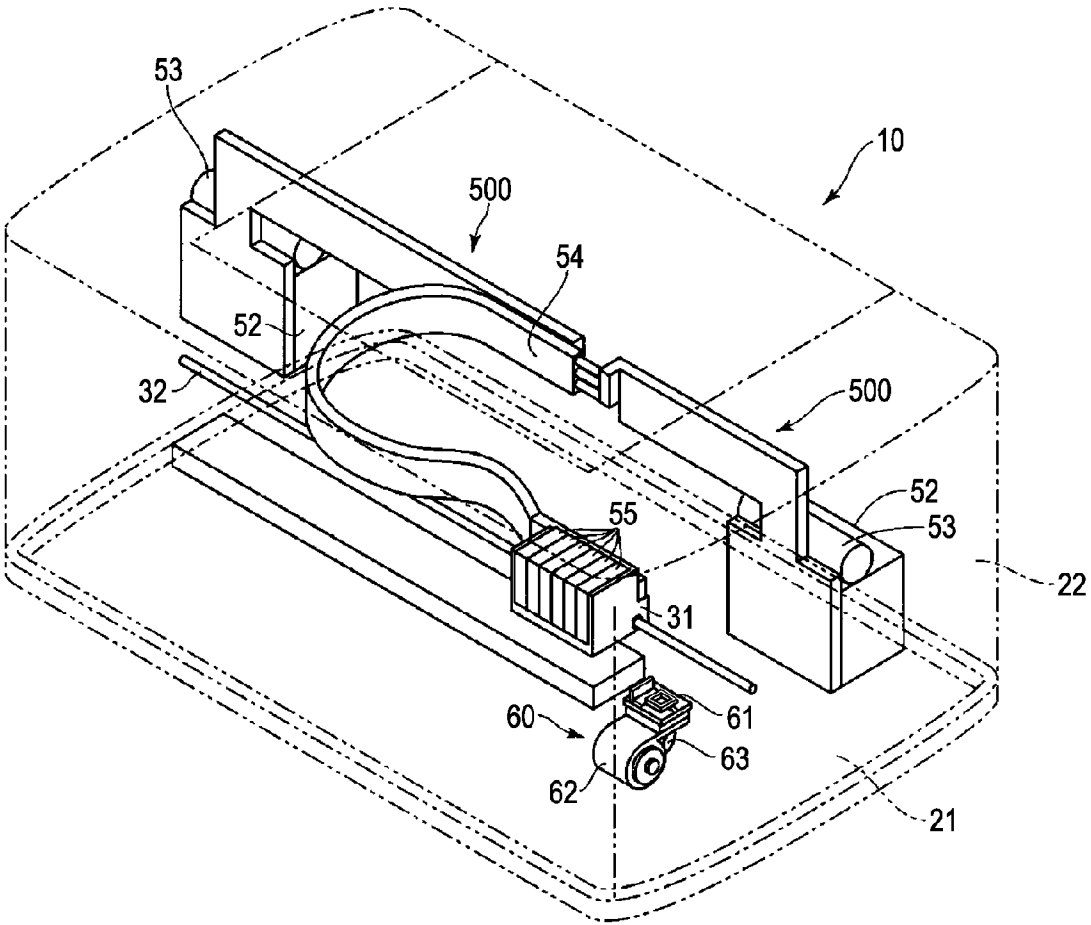
FIG. 1 is a perspective view illustrating a configuration of a printer according to a first embodiment of the invention.

Hereinafter, a printer 10 will be described as an example of a liquid ejection apparatus according to a first embodiment of the invention with reference to FIGS. 1 to 8. In the following description, a lower side indicates an installation side of the printer 10 and an upper side indicates the opposite side of the installation side. It is also assumed that a direction in which a carriage 31 moves is a main scanning direction and that a direction which is perpendicular to the main scanning direction and in which a printing object P is transported is a sub scanning direction. It is assumed that a side from which the printing object P is fed is a paper feed side and that a side from which the printing object P is discharged is a paper discharge side.

Configuration of Printer

First, a configuration of the printer 10 will be described with reference to FIG. 1, according to the first embodiment of the invention, where the upstream side in a paper feeding direction is shown as the front of the illustration and the downstream side (paper discharge side) is disposed in the back of the illustration. FIG. 2 is a diagram schematically illustrating the configuration of the printer 10. The printer 10 according to this embodiment includes a chassis 21, a housing 22, a carriage mechanism 30, a paper feed mechanism 40, an ink supply mechanism 50, a cleaning mechanism 60, and a controller 70.

The bottom surface of the chassis 21 comes in contact with an installation surface and the chassis 21 is mounted with various units. The housing 22 is indicated by a dotted line in FIG. 1 and is attached to the chassis 21. The housing 22 has a shape that corresponds to the chassis 21.

Figure 2:
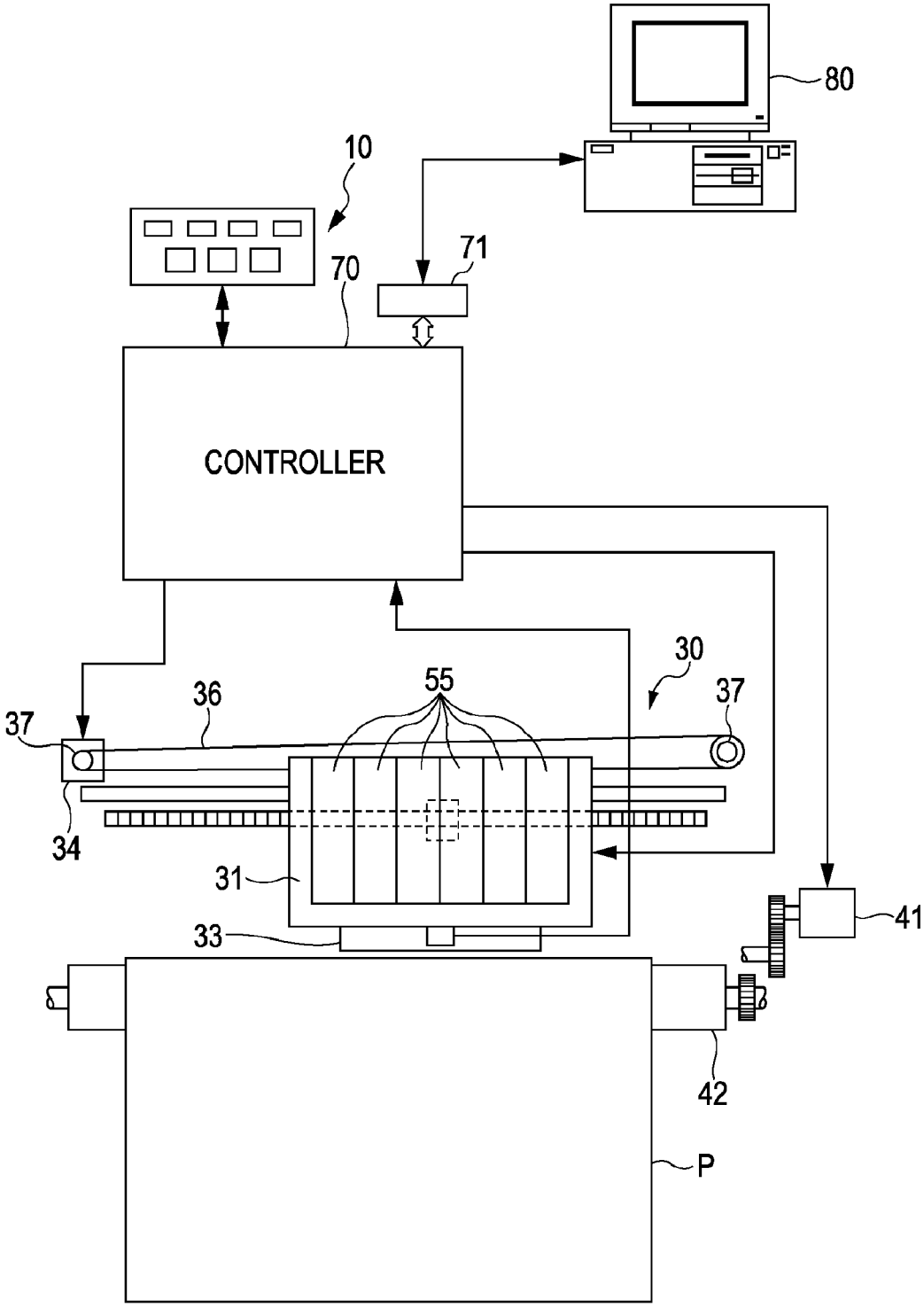
FIG. 2 is a diagram illustrating the configuration of the printer shown in FIG. 1.

As shown in FIGS. 1 and 2, the carriage mechanism 30 includes a carriage 31, a carriage shaft 32 on which the carriage 31 slides, and a print head 33. The carriage mechanism 30 further includes a carriage motor (CR motor) 34, a saw tooth pulley 35 attached to the CR motor 34, an endless belt 36, and a driven pulley 37 which suspends the endless belt 36 in cooperation with the saw tooth pulley 35. The ink or other liquid is supplied by the ink supply mechanism 50 and is ejected to a printing object P from the print head 33 acting as an ejection head.

As shown in FIG. 2, the paper feed mechanism 40 includes a paper feed motor (PF) 41 and a paper feed roller 42 to which a driving force is transmitted from the paper feed motor 41.

The printer 10 according to this embodiment is a so-called off carriage type in which an ink cartridge 51, acting liquid container, is attached to the chassis 21. Accordingly, as shown in FIG. 1, the ink supply mechanism 50 of the printer 10, acting as a liquid source, includes a cartridge holder 52, a pressurizing pump 53, an air tube 54, a flexible tube 55, and a sub tank 56. The ink supply mechanism 50 further includes a plate-like tube 500.

Figure 3:
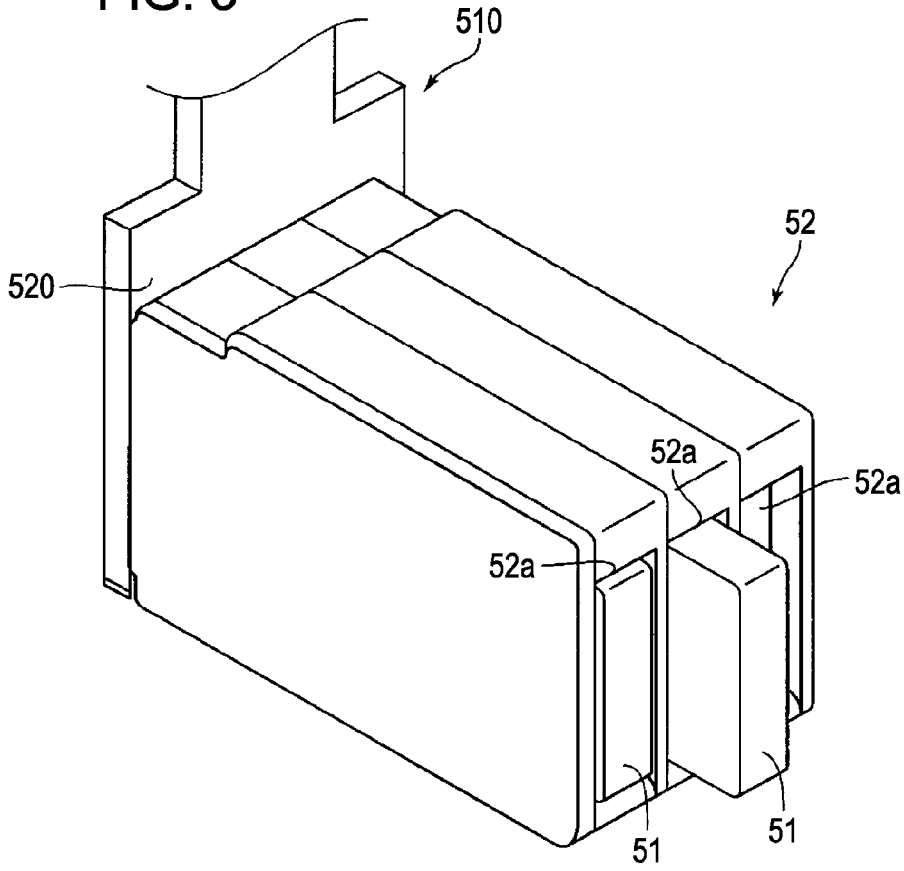
FIG. 3 is a perspective view illustrating a configuration of a cartridge holder of the printer shown in FIG. 1.

The cartridge holder 52 is shown in FIG. 3, and acts as an attachment section to which the ink cartridge 51 (shown in FIG. 4) is attached and is fixedly attached to the chassis 21. The cartridge holder 52 is provided with an insertion port 52*a* into which the ink cartridge 51 is inserted. In this embodiment, two cartridge holders 52 are disposed in each end of the printer 10 in the main scanning direction. The position where the cartridge holder 52 is attached to the chassis 21 is disposed in a region away from the movable space of the carriage 31. Specifically, the cartridge holder 52 is disposed outside the space where the carriage 31 reciprocates in the longitudinal direction and is disposed closer to the paper discharge side of the printing object P, so as to be outside the space where the carriage 31 reciprocates.

Figure 7:
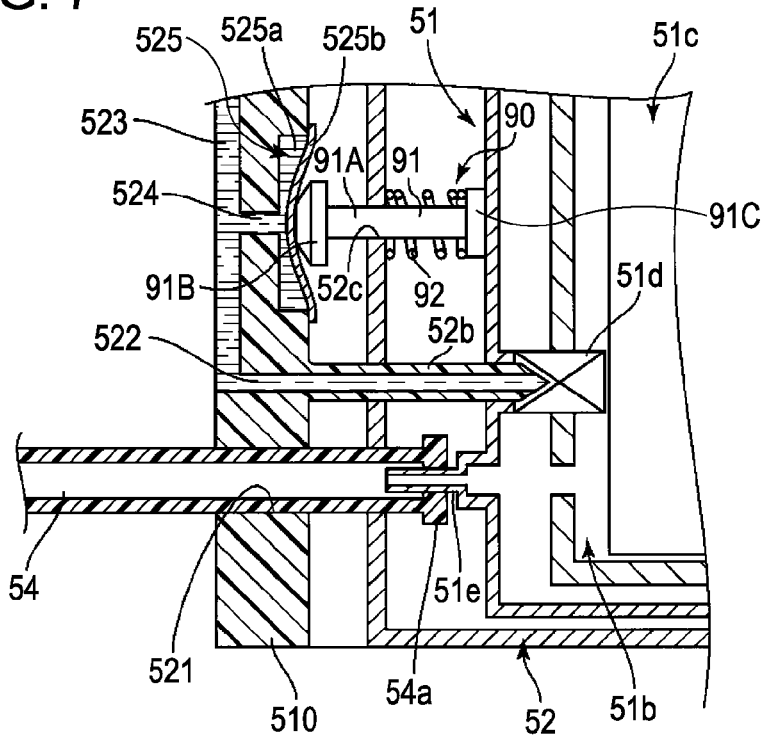
FIG. 7 is a sectional view illustrating a configuration of a pressure buffering chamber and the periphery thereof according to the first embodiment of the invention.

As shown in FIG. 7, an insertion hole 52*c* is disposed in a portion of the cartridge holder 52 opposed to the plate-like tube 500. The insertion hole 52*c* serves to house push rod 91. A push mechanism 90 is attached to the cartridge holder 52 by the use of the insertion hole 52*c*.

Figure 4:
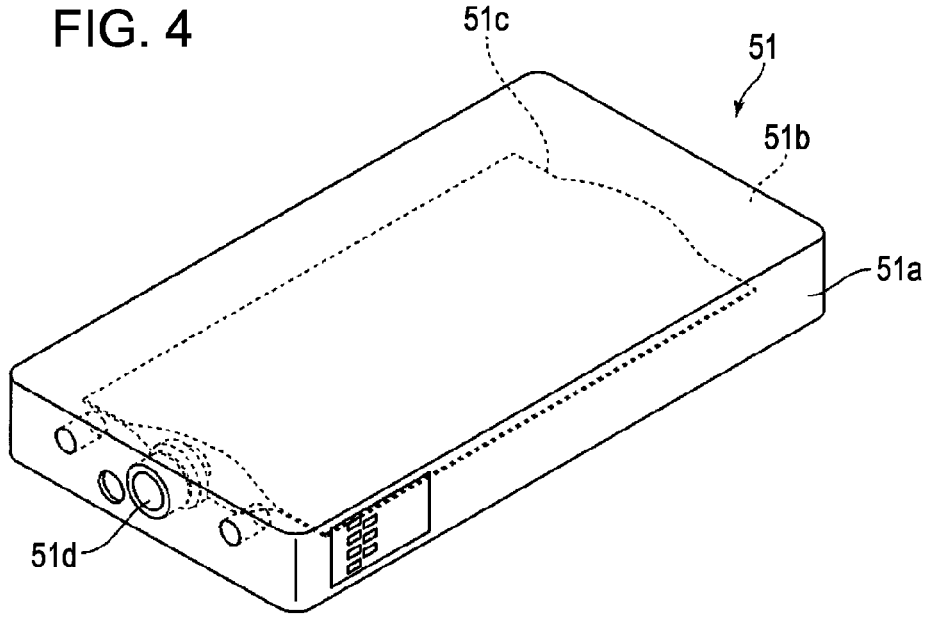
FIG. 4 is a perspective view illustrating a configuration of an ink cartridge of the printer shown in FIG. 1.

A plurality of ink cartridges 51 (three, in this example) are detachably attached to the pair of cartridge holders 52 through the insertion ports 52*a*. As shown in FIG. 4, each ink cartridge 51 has an air chamber 51*b* in a casing 51*a* thereof and an ink pack 51*c* filled with ink is received in the air chamber 51*b*. The ink pack 51*c* is an air-tight bag-like member such as an aluminum pack, and ink is contained in the ink pack 51*c*.

As shown in FIG. 7, the ink cartridge 51 includes an ink supply port 51*d* which is capable of communicating with the inside of the ink pack 51*c*. An ink supply needle 52*b* disposed in the cartridge holder 52 is inserted into the ink supply port 51*d*. A film not shown is attached to the ink cartridge 51 so as to cover the ink supply port 51*d*. When the ink cartridge 51 is attached to the cartridge holder 52, the ink supply needle 52*b* punctures the film in order to connect the ink supply needle 52*b* and ink supply port 51*d* so as to allow the ink to flow through the ink supply needle 52*b*. Accordingly, the ink in the ink pack 51*c* can be supplied to a pressure buffering chamber 525 through the ink supply port 51*d*.

As shown in FIG. 7, the ink cartridge 51 includes a tube engaging portion 51*e*. The tube engaging portion 51*e* communicates with the air chamber 51*b* and serves to engage with a connection plug 54*b* disposed at an end of the air tube 54. That is, when the ink cartridge 51 is attached to the cartridge holder 52, while the tube engaging portion 51*e* engages with the connection plug 54*b*. Then, the air supplied from the air tube 54 can be introduced into the air chamber 51*b*. When the ink cartridge 51 is detached from the cartridge holder 52, the tube engaging portion 51*e* is disengaged from the connection plug 54*b*. In this case, the inside of the air tube 54 is exposed to the outside atmosphere through the connection plug 54*b*.

As shown in FIG. 1, the pressurizing pump 53 is connected to the cartridge holder 52. The pressurizing pump 53 corresponds to a part of the pressurizing member and serves to supply air into the air chamber 51*b* of the ink cartridge 51 through the air tube 54. By enhancing the pressure of the air chamber 51*b*, the ink pack 51*c* is pressed and deformed. The ink in the ink pack 51*c* is pushed to the plate-like tube by the deformation and caused to flow through a pressure buffering chamber 525 and first ink channel 532 into the plate-like tube 500. Details of the plate-like tube 500 will be described more fully below.

One end of the air tube 54 is connected to the pressurizing pump 53 while the other end thereof is provided with the connection plug 54*b*. The air tube is formed of a flexible material such as an elastomer resin. The air tube 54 corresponds to a part of the pressurizing member. The connection plug 54*b* of the air tube 54 engages with the tube engaging portion 51*e*. When the pressurizing pump 53 is activated in this engaged state, it is possible to supply air into the air chamber 51*b*.

As shown in FIG. 1, one end of the flexible tube 55 is connected to the downstream end of the plate-like tube 500 in the ink flowing direction. The flexible tube 55 is formed of a flexible material such as an elastomer resin. Accordingly, the flexible tube 55 is bent so as to not hinder the reciprocation or movement of the carriage 31 in the main scanning direction. A hollow tube channel (not shown) is disposed in the flexible tube 55 so as to extend in the longitudinal direction thereof. The ink channels 523, 532, and 535 communicate with the tube channel to allow the ink to flow through them.

A sub tank 56 is connected to the other end of the flexible tube 55. The sub tanks 56 are disposed on the carriage 31 so as to correspond to the number of ink cartridges 51. The ink flowing through the ink channels 523, 532, and 535 and the tube channel can be temporarily stored in the sub tank 56. The ink stored in the sub tank 56 is ejected from the print head 33 disposed on the bottom of the carriage 31.

As shown in FIG. 1, the cleaning mechanism 60 is disposed in the chassis 21. The cleaning mechanism 60 includes a cap 61, a suction pump 62, and an ink discharge tube 63. The cap 61 serves to seal a nozzle forming surface (not shown) of the print head 33. When the suction pump 62 is activated in the sealed state, the ink is discharged to a waste tank (not shown) through an ink discharge tube 63. By means of the ink sucking operation, the plate-like tube 500 can perform a so-called cleaning operation wherein any bubbles in the flexible tube 55 or the print head 33 are forcibly discharged.

As shown in FIG. 2, the printer 10 includes the controller 70. The controller 70 includes an interface 71, a CPU not shown, a memory, an ASIC (Application Specific Integrated Circuit), a bus, and a timer. Based on signals input from various sensors, the controller 70 controls the driving of the CR motor 34, the PF motor 41, the pump motor (not shown) of the pressurizing pump 53, a pump motor (not shown) of the suction pump 62, and the print head 33.

The printer 10 includes an interface 71. The printer 10 is connected to a computer 80 through the interface 71 (see FIG. 2). The computer 80 includes a CPU, a RAM, a ROM, a HDD (Hard Disk Drive), and a user interface (not shown). Application programs for processing an image, printer driver programs, video driver programs, and the like may be stored in the HDD.

Configuration of Push Mechanism

A configuration of the push mechanism 90 will be described with reference to FIGS. 7 and 8. The push mechanism 90 corresponds to the push member and includes a push rod 91 and a coil spring 92 corresponding to the movement member. The push rod 91 includes a rod portion 91A, a push portion 91B, and a bearing portion 91C.

The rod portion 91A is a cylindrical rod-shaped member which is disposed to be freely moved through the insertion hole 52*c*. The push portion 91B is disposed on one end of the rod portion 91A opposed to a liquid staying portion 525*a*. The push portion 91B may be formed in the same component as the rod portion 91A, or the rod portion 91A and the push portion 91B may be formed separately and connected to each other. The push portion 91B has a diameter that is larger than the rod portion 91A. Accordingly, when the rod portion 91A slides in the direction away from the liquid staying portion 525*a*, the push portion 91B prevents the push rod 91 from dropping out of the insertion hole 52*c*.

The push portion 91B has a convex shape wherein one side comes into contact with a flexible film 525*b* described more fully below, so as to decrease the volume of liquid staying portion 525*a* using the tip of the push portion 91B. When the push portion 91B contacts the flexible film 525*b*, the contact is relatively gentle, thereby preventing the damage of the flexible film 525*b*. The push portion 91B may have various lateral shapes such as a trapezoidal shape and a semi-circular shape.

The bearing portion 91C is disposed at the other end of the rod portion 91A. The bearing portion 91C may be formed as a component of the rod portion 91A, or the rod portion 91A and the bearing portion 91C may be formed separately and subsequently connected to each other. The bearing portion 91C has a diameter that is larger than the rod portion 91A. The bearing portion 91C includes a coil spring 92 on the side opposed to the liquid staying portion 525*a*.

The bearing portion 91C can come in contact with the ink cartridge 51 on the side opposite to the liquid staying portion 525*a*. That is, when the ink cartridge 51 is attached to the cartridge holder 52, as shown in FIG. 7, the bearing portion 91C may come in contact with a casing 51*a* of the ink cartridge 51. At this time, the bearing portion 91C may come into contact with the casing 51*a* when a movement force is applied thereto from the coil spring 92. As shown in FIG. 8, when the ink cartridge 51 is not attached to the cartridge holder 52, the bearing portion 91C is pushed toward the right in FIG. 8 (in a direction away from the liquid staying portion 525*a*) by the coil spring 92.

Figure 8:
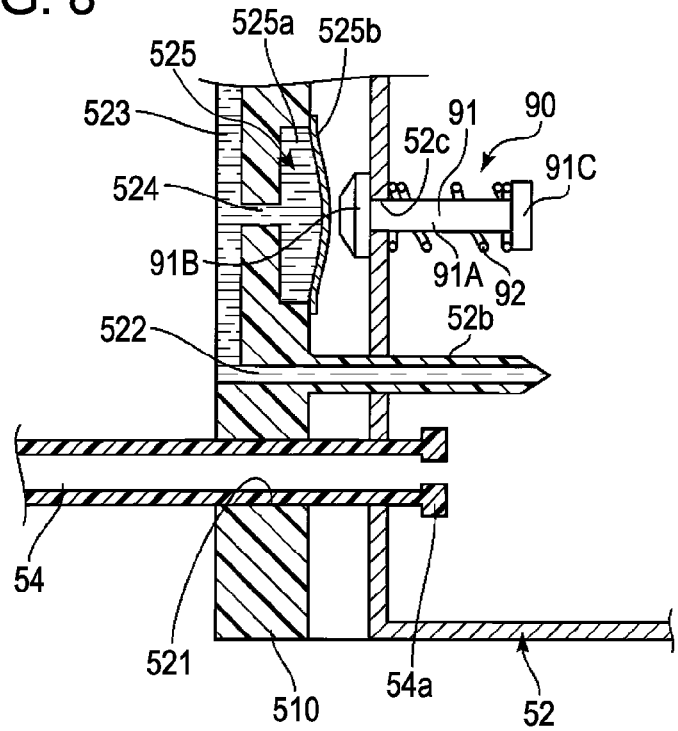
FIG. 8 is a sectional view illustrating a state where a flexible film is bent toward a pressurizing chamber according to the first embodiment of the invention.

As shown in FIG. 8, when the ink cartridge 51 is not attached, the push portion 91B has a predetermined clearance so as not to come in contact with the flexible film 525*b*. As shown in FIG. 7, when the ink cartridge 51 is attached, the push portion 91B pushes the flexible film 525*b*, but the distance that the liquid staying portion is compressed is not sufficient to cause the push portion 91B to reach the bottom of the liquid staying portion 525*a*.

The coil spring 92 is a portion serving as the movement member which gives the movement force which causes the push rod 91 to move in the direction away from the liquid staying portion 525*a*. The rod portion 91A is inserted through the center of the coil spring 92. An end of the coil spring 92 comes in contact with the inner wall of the cartridge holder 52 and the other end of the coil spring 92 comes in contact with the bearing portion 91C. The coil spring 92 is the most expanded when the ink cartridge 51 is in the non-attached state, but is disposed to apply a slight movement force to the bearing portion 91C in the most expanded state. In the state where the coil spring 92 is the most expanded, the push portion 91A comes in contact with the outer wall of the cartridge holder 52.

Configuration of Plate-Like Tube

A configuration of the plate-like tube 500 having a pressure buffering mechanism will be described with reference to FIG. 1 and FIGS. 5 to 8. As shown in FIG. 1, in this embodiment, two plate-like tubes 500 and 500 are disposed in the main scanning direction. Two plate-like tubes 500 and 500 are slightly different from each other in length and the like, but have subsequently the same elements, and are described below as a plate-like tube 500.

Each plate-like tube 500 roughly includes a tube plate 510 and a film 560. The tube plate 510 is formed of a (hard) resin material having high hardness such as acryl. The film 560 is formed of thermoplastic resin such as polyethylene terephthalate and nylon. The film 560 is attached to the tube plate 510 by the use of a thermal pressing method or the like. The film 560 may have a configuration of a plurality of laminated layers. In this case, the laminated layers may comprise thermoplastic resin layers of polypropylene or polyethylene which are stacked on the above-mentioned material so as not to transmit steam.

Figure 5:
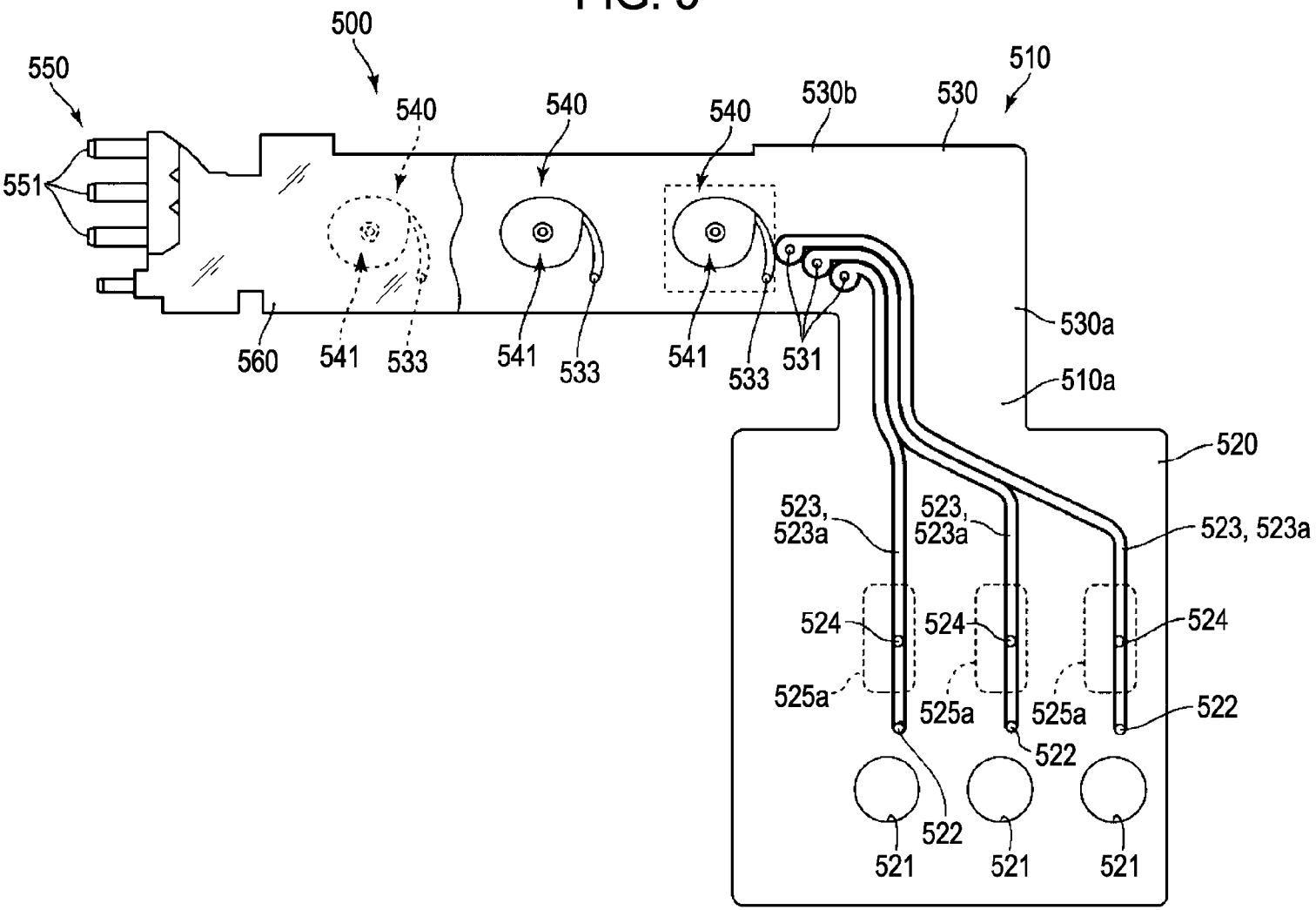
FIG. 5 is a front view illustrating a configuration of a plate-like tube of the printer shown in FIG. 1.

As shown in FIG. 5, the tube plate 510 includes a holder attaching portion 520, a channel forming portion 530, and a tube connecting portion 550. The holder attaching portion 520 is fixed to the cartridge holder 52 and the appearance thereof in this embodiment has a substantially square shape. A plurality of through holes 521 (three in this embodiment) corresponding to the number of ink cartridges 51 are formed in the lower portion of the holder attaching portion 520. The air tubes 54 supply air from the pressurizing pump 53, and are inserted into the through holes 521. The air tubes 54 communicate with the air chamber 51*b* of the ink cartridge 51 and serve to supply the air to the air chamber 51*b* to press and deform the ink pack 51*c*.

An ink outflow hole 522 is formed above each through hole 521. The ink outflow hole 522 communicates with the ink supply needle 52*b* disposed in the cartridge holder 52. When the ink cartridge 51 is attached to the cartridge holder 52, the ink supply port 51*d* (see FIGS. 4 and 7) of the ink cartridge 51 communicates with the ink supply needle 52*b*, thereby allowing the ink in the ink pack 51*c* to flow from the ink outflow hole 522. The ink outflow hole 522 serves as an entrance for introducing the ink into a first ink channel 523.

A first groove 523*a* constituting the first ink channel 523 communicates with the ink outflow hole 522. The first groove 523*a* is a groove-shaped channel which is formed concave in the tube plate 510. The first groove 523*a* is formed on a surface of the tube plate 510 opposite to the surface to which the cartridge holder 52 is attached. In the description below, the surface of the tube plate 510 to which the cartridge holder 52 is attached is described as a rear surface 510*b* (shown in FIG. 6) and the opposite surface (shown in FIG. 5) thereof is a surface 510*a*.

The first groove 523*a* extends from the holder attaching portion 520 to the channel forming portion 530. As shown in FIG. 5, the channel forming portion 530 has substantially a "L" shape. The first groove 523*a* extends along the vertical portion 530*a* away from the holder attaching portion 520 in the L-shaped channel forming portion 530 and reaches a portion in the area of the horizontal portion 530*b*. The area is provided with a through hole 531. The through hole 531 communicates with the first groove 523*a* on the surface 510*a* and communicates with a second groove 532*a* on the rear surface 510*b*.

As shown in FIG. 7, a flow hole 524 facing the rear surface 510*b* is formed in the first groove 523*a*. The flow hole 524 communicates with the liquid staying portion 525*a*. The liquid staying portion 525*a* is a portion which is indented from the rear surface 510*b* of the tube plate 510 toward the surface 510*a*. The indented position corresponds to the push of the push portion 91B. The liquid staying portion 525*a* is indented in a predetermined area which is suitable for properly storing the ink.

Figure 6:
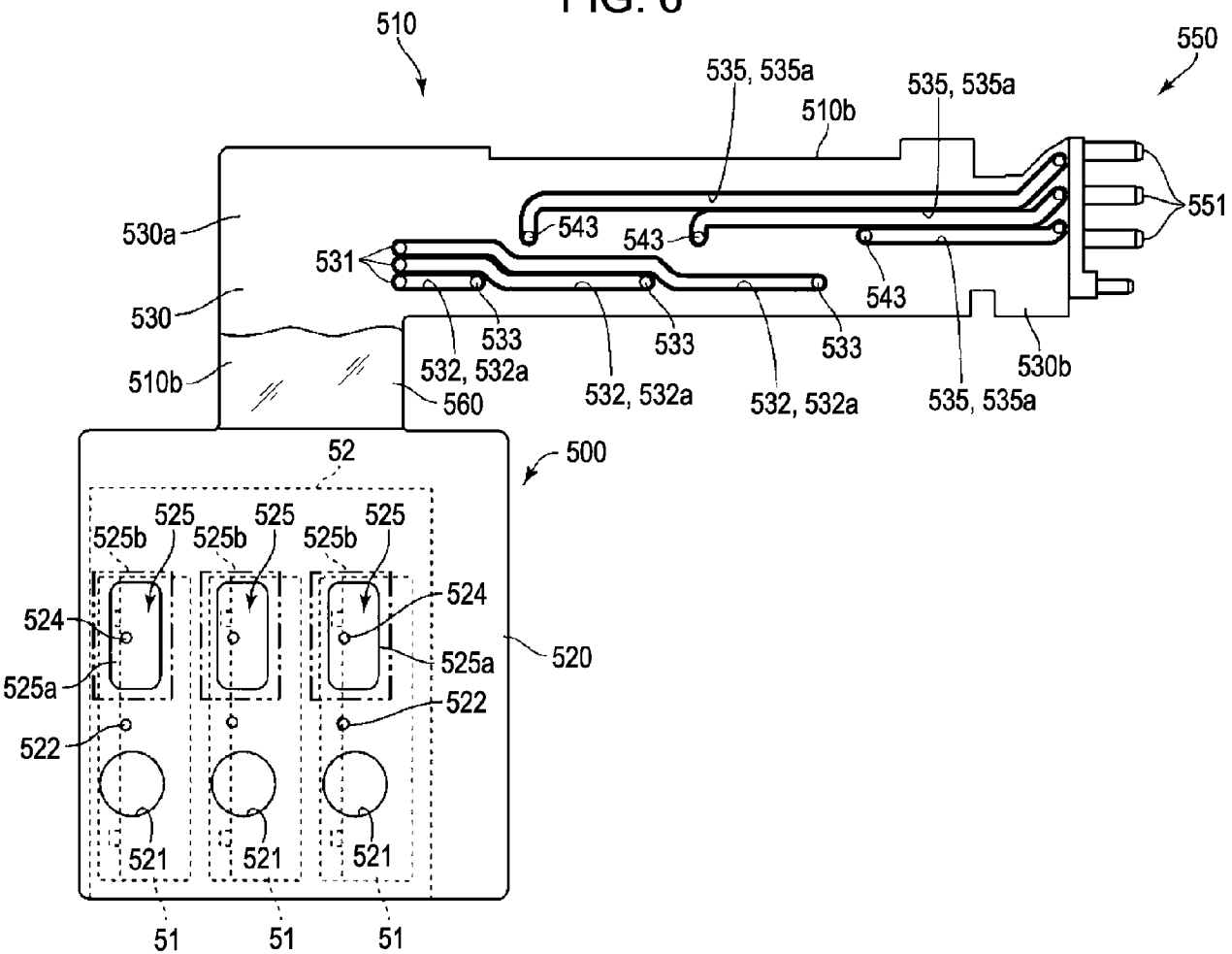
FIG. 6 is a rear view illustrating a configuration of the plate-like tube of the printer shown in FIG. 1.

As shown in FIGS. 6, 7, and 8, a flexible film 525*b* is the flexible member and the film member is attached to cover the liquid staying portion 525*a*. The flexible film 525*b* and the liquid staying portion 525*a* constitute a pressure buffering chamber 525. The flexible film 525*b* is disposed at a position, which comes in contact with the push portion 91B, on the rear surface 510*b* of the tube plate 510.

The liquid staying portion 525*a* and the flexible film 525*b* constitute the pressure buffering chamber 525 which correspond to the pressure buffer and the volume varying member, respectively. The flexible film 525*b* corresponds to the flexible member and the film member.

When the ink cartridge 51 is attached, the flexible film 525*b* is pushed by the push portion 91B and thus the volume of the pressure buffering chamber 525 is greatly reduced (see FIG. 7). On the contrary, when the ink cartridge 51 is detached, the push of the flexible film 525*b* is released. Accordingly, the flexible film 525*b* is bent away from the bottom of the liquid staying portion 525*a*.

As shown in FIG. 6, the second groove 532*a* is disposed in the horizontal portion 530*b*. The second groove 532*a* is disposed on the rear surface 510*b* of the horizontal portion 530*b* so as to avoid the interference with a choke valve chamber 541 described more fully below. The second groove 532*a* constitutes the second ink channel 532 by attaching the film 560 to the rear surface 510*b*. An inflow hole 533 is disposed at a downstream end of the second groove 532*a*. The inflow hole 533 is capable of introducing the ink into an ink introduction channel 534 described later by penetrating the horizontal portion 530*b*. The inflow hole 533 is located at an end (on the lower side) in the width direction of the horizontal portion 530*b*.

In this embodiment, three choke valve chambers 541 (see FIG. 5) and ink introduction channels 534 are used which are capable of introducing the ink into the choke valve chambers 541 through the inflow holes 542 are disposed on the surface 510*a* of the horizontal portion 530*b*. The ink flows in the ink introduction channel 534 from the inflow hole 533. The other end of the ink introduction channel 534 is connected to the choke valve chamber 541 at the inflow hole 542 and is located at the other end (on the upper side) in the width direction of the horizontal portion 530*b*.

A discharge hole 543 is formed substantially at the center of each choke valve chamber 541. The discharge hole 543 penetrates the horizontal portion 530*b* from the bottom 541*b* of each choke valve chamber 541 to the rear surface 510*b*. The discharge hole 543 communicates with a third groove 535*a* on the rear surface 510*b*. Accordingly, the ink flowing in each choke valve chamber 541 can be made to flow to the third groove 535*a* through the discharge hole 543. In the bottom of each choke valve chamber 541, a convex portion (not shown) is disposed around the discharge hole 543. The convex portion is formed to protrude in a ring-like shape from the bottom of each choke valve chamber 541 toward the surface. The film 560 can be attached to and detached from the top of the convex portion.

The film 560 can be easily bent by a difference in pressure between the choke valve chamber 541 and outside of the film 560 opposite to the choke valve chamber 541. When the pressure of the choke valve chamber 541 is greater than the outside, the film 560 is bent away from the bottom of the choke valve chamber 541. In this case, a predetermined gap is created between the top of the convex portion and the film 560. Thus, the ink can flow through the gap and the ink can flow to the discharge hole 543 (third groove 535*a*). On the contrary, when pressure of the outside is greater than that of the choke valve chamber 541, the film 560 is bent towards the bottom of the choke valve chamber 541. In this case, the film 560 comes in contact with the top of the convex portion all over the entire circumference thereof. Accordingly, the ink does not flow out of the discharge hole 543 and the flow thereof is blocked. In this way, a choke plate 540 can permit or block the ink flow.

The third groove 535*a* is disposed in the horizontal portion 530*b*. An end of the third groove 535*a* communicates with the discharge hole 543 and the other end communicates with a tube connecting portion 550. The third groove 535*a* constitutes a third ink channel 535 by attaching the film 560 thereto. The third groove 535*a* is disposed on the rear surface 510*b*.

The tube connecting portion 550 is connected to the flexible tube 55. The tube connecting portion 550 is provided with a pipe-shaped connection tube 551. By inserting the connection tube 551 into the tube channel of the flexible tube 55, the tube connecting portion 550 communicates with the tube channel.

Ink Supply Operation of Printer

The ink supply operation of the printer 10 will be described now. Before performing the ink supply operation, a user attaches the ink cartridges 51 to the cartridge holders 52. Before the ink cartridge 51 is attached, the bearing portion 91C does not come in contact with the casing 51*a* as shown in FIG. 8. Accordingly, the push rod 91 is located at a position spaced from the liquid staying portion 525*a* by means of the movement force of the coil spring 92. Thus, the push portion 91B and the flexible film 525*b* have a predetermined gap between them and thus are in a non-contact state.

When the user attaches the ink cartridge 51 by inserting the ink cartridge into the insertion port 52*a*, the ink cartridge 51 goes into the cartridge holder 52, where the bearing portion 91C collides with the casing 51*a*. Then, the push rod 91 goes toward the bottom of the liquid staying portion 525*a* against the movement force of the coil spring 92. Then, the push portion 91B pushes the flexible film 525*b* toward the bottom of the liquid staying portion 525*a* until the ink cartridge 51 reaches a correct attachment position.

In this state, the ink can be supplied from the ink cartridge 51. When the pressurizing pump 53 is activated in accordance with an instruction from the controller 70, air is supplied to the air chamber 51*b* through the air tube 54. The ink pack 51*c* is pushed and deformed with the supply of air. Accordingly, the ink starts flowing in the flow channels (the first ink channel 523, the second ink channel 532, the third ink channel 535, the tube channel of the flexible tube 55, and the like) through the ink outflow hole 522 and is supplied to the sub tank 56. In this way, the ink is supplied to the flow channels.

As described above, when the supply of ink to the flow channel up to the sub tank 56 is started, the inside pressure (liquid pressure) of the flow channel is higher than the atmospheric pressure. Accordingly, the flexible film 525*b* constituting the pressure buffering chamber 525 bends away from the bottom of the liquid staying portion 525*a*, but is held by the push rod 91. Accordingly, the flexible film 525*b* does not bend away from the bottom of the liquid staying portion 525*a* and thus the volume of the pressure buffering chamber 525 is smaller than the volume of the liquid staying portion 525*a*.

For example, when a user is notified by a screen display of the computer 80 that the ink is running short, the user replaces the ink cartridge 51. During this process, the ink cartridge 51 is detached by the user. At this time, the contact between the bearing portion 91C and the casing 51*a* is released and the push rod 91 is not held against the spring force of the coil spring 92 and moves away from the liquid staying portion 525*a*. Accordingly, the push portion 91B is separated by a predetermined gap from the flexible film 525*b* (see FIG. 8).

At this time, in the configurations known in the art, the flow channel (the flexible tube 55, the plate-like tube 500, and the like) through which the ink flows, has an inside pressure that is higher than the atmospheric pressure because a pressurizing pump 53 is activated to reduce the pressure before the ink cartridge 51 is detached. Accordingly, at the time of detaching the ink cartridge 51, any elastic force resulting from the swelling of the flexible tube 55 and the like due to the inner pressure thereof is released and the flexible tube 55 contracts by the elastic force, whereby the ink tends to be extrude from the ink supply needle 52*b*.

In the configuration of the invention, however, when the ink cartridge 51 is detached, the push of the push rod 91 to the flexible film 525*b* is also released as described above. Accordingly, as shown in FIG. 8, the ink flowing to the ink supply needle 52*b* bends the flexible film 525*b* of the pressure buffering chamber 525 away from the bottom of the liquid staying portion 525*a* due to the difference between the atmospheric pressure and the inner pressure of the flow channel. At this time, the flexible film 525*b* can be bent by the inner pressure (liquid pressure) of the flow channel. Accordingly, the volume of the pressure buffering chamber 525 increases and the ink is not extruded from the ink supply needle 52*b* with a predetermined force but is absorbed by the increasing volume.

In this embodiment, even when the flexible film 525*b* is furthest away the bottom of the liquid staying portion 525*a*, the flexible film 525*b* and the push portion 91B are not in contact with each other.

Advantage of First Embodiment

In the printer 10, the pressure buffering chamber 525 is disposed in the middle of the flow channel. When the ink is supplied, the flexible film 525*b* of the pressure buffering chamber 525 is pushed by the push portion 91B. However, when the ink cartridge 51 is detached, the push of the push portion 91B is released. Accordingly, the inner volume of the pressure buffering chamber 525 increases by means of releasing the push at the time of detaching the ink cartridge 51. Therefore, even when the flow channel is pressurized and the ink tends to be extruded from the ink supply needle 52*b*, it is possible to prevent the extrusion of ink by the increase of the inner volume. As a result, it is possible to prevent the ink from being extruded to contaminate the cartridge holder 52 or the printing object P when the ink cartridge 51 is detached. Since it is possible to prevent the extrusion of ink, it is not necessary to additionally provide a portion for receiving the extruded ink, thereby suppressing the increase in cost.

In this embodiment, the flexible film 525*b* is towards and away from a liquid staying portion 525*a* with the push of the push rod 91. Accordingly, when the push of the push rod 91 is released, the flexible film 525*b* is bent away from the liquid staying portion 525*a* with the inner pressure of the pressure buffering chamber 525 and the inner volume of the pressure buffering chamber 525 increases to absorb the pressure of the liquid.

In this embodiment, the bearing portion 91C of the push rod 91 can come in contact with the ink cartridge 51 and creating the tension when the ink cartridge is attached. When the ink cartridge 51 is detached from the cartridge holder 52, the coil spring 92 moves the bearing portion 91C. Accordingly, the push portion 91B can be satisfactorily separated from the flexible film 525*b* in cooperation with the detaching operation.

The liquid staying portion 525*a* is disposed in the hard tube plate 510 and the flexible film 525*b* is formed of a thin film member. Accordingly, the flexible film 525*b* can easily bend in association with the pressure of the ink and the pressure of the pressurizing chamber 527. Since the flexible film 525*b* is easily bent, the elastic force corresponding to the bending of the flexible film 525*b* does not act toward the pressure buffering chamber 525. Accordingly, when the flexible film 525*b* is bent in the direction away from the bottom of the liquid staying portion 525*a*, making it possible to prevent the increase in pressure of the pressure buffering chamber 525.

The liquid staying portion 525*a* is disposed in the plate-like tube 500 located upstream the flexible tube 55. Since the flexible tube 55 has flexibility, the flexible tube may bend so as to swell with the pressurization of the pressurizing pump 53 and the like. Accordingly, at the time of detaching the ink cartridge 51, the flexible tube 55 tends to contract due to the release of the pressurized state and the ink flows upstream with the contraction. However, since the liquid staying portion 525*a* (pressure buffering chamber 525) is disposed upstream the flexible tube 55, the pressure of the ink can be absorbed. Accordingly, it is possible to prevent the ink from being extruded to contaminate the cartridge holder 52 or the printing object P at the time of detaching the ink cartridge 51.

Second Embodiment

Hereinafter, a second embodiment of the invention will be described with reference to FIGS. 9 to 12. Since the second embodiment includes the elements common to the first embodiment, like elements are denoted by like reference numerals and differences from the first embodiment will be described mainly.

Configuration of Plate-Like Tube

Figure 11:
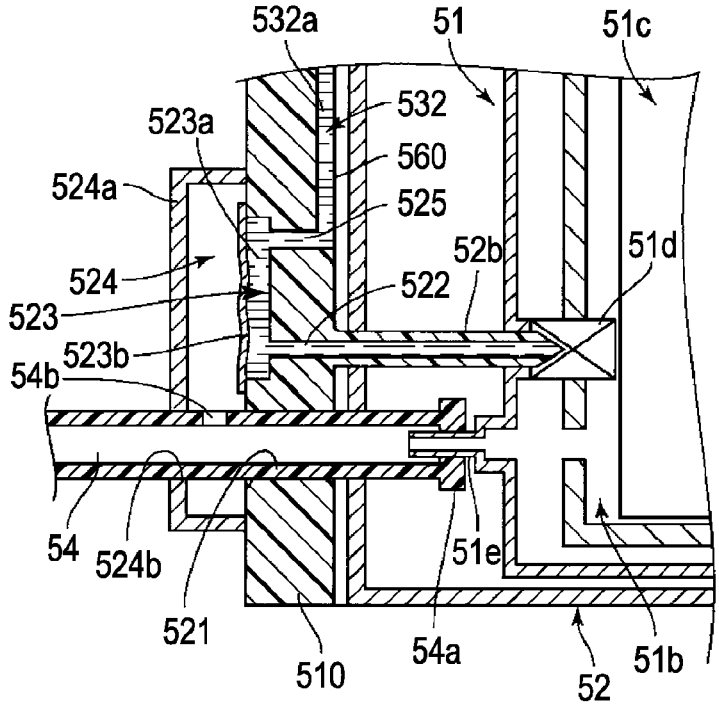
FIG. 11 is a sectional view illustrating a configuration of a pressure buffering chamber and the periphery thereof according to the second embodiment of the invention.
Figure 12:
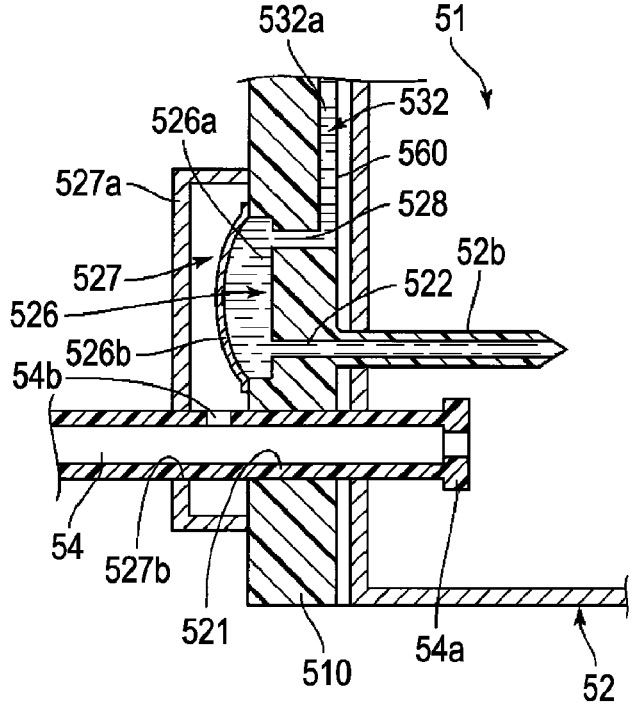
FIG. 12 is a sectional view illustrating a state where a flexible film is bent so as to swell according to the second embodiment of the invention.

In this embodiment, the pressure buffering chamber 526 is different from the pressure buffering chamber 525 previously described. That is, a concave staying portion 526*a* constituting the pressure buffering chamber 526 communicates with the ink outflow hole 522. As shown in FIGS. 11 and 12, the concave staying portion 526*a* constituting the pressure buffering chamber 526 is more concave than any other portion of the tube plate 510. The concave staying portion 526*a* is disposed on the surface of the tube plate 510 opposite to the surface to which the cartridge holder 52 is attached.

Figure 9:
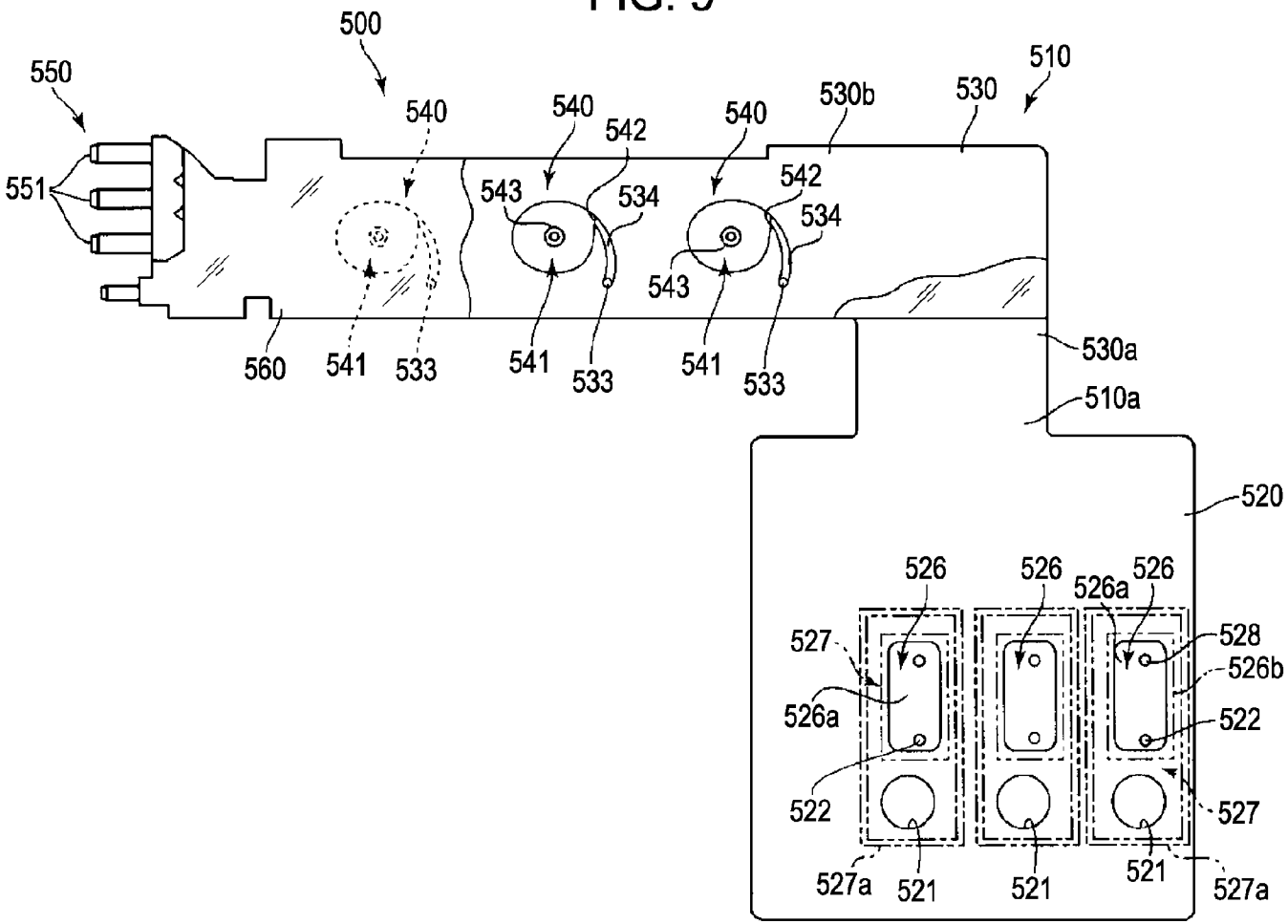
FIG. 9 is a front view illustrating a configuration of a plate-like tube according to a second embodiment of the invention.

As shown in FIGS. 9, 11, and 12, a flexible film 526*b* is attached to cover the concave staying portion 526*a*. The pressure buffering chamber 526 is constituted by the flexible film 526*b* and the staying concave portion 526*a*. The flexible film 526*b* is attached to the surface 510*a* of the tube plate 510. The flexible film 526*b* is bent to away the bottom of the concave staying portion 526*a* or to be close to the bottom of the concave staying portion 526*a*, depending on the inner pressure of a pressurizing chamber 527 described more fully below.

The concave staying portion 526*a* and the flexible film 526*b* constituting the pressure buffering chamber 526 correspond to the pressure buffer and the volume varying member. The flexible film 526*b* corresponds to the flexible member and the film member.

As shown in FIG. 11, a case body 527*a* is attached to cover the pressure buffering chamber 526. The case body 527*a* corresponds to a part of the pressurizing member. The case body 527*a* has a box-like shape with an opened end which faces the surface. The case body 527*a* is fixed to the surface 510*a* so that the air flowing in the case body 527*a* does not leak. Accordingly, the pressurizing chamber 527 is formed to form an air-tight cover on the pressure buffering chamber 526. A tube insertion hole 527*b* is disposed in a portion of the case body 527*a* (the lower side in FIG. 9) opposite to the pressure buffering chamber 526 as viewed from the front. The tube insertion hole 527*b* is a hole allowing the air tube 54 to be inserted there-through. The air tube 54 is inserted into the through hole 521 through the tube insertion hole 527*b*.

A communicating hole 54*a* communicating with the channel of the air tube 54 is disposed in the air tube 54. The communicating hole 54*a* communicates with the pressurizing chamber 527. Accordingly, when the pressurizing pump 53 is activated to supply the air, the supplied air is sent to the air chamber 51*b* through the air tube 54 and is also sent to the pressurizing chamber 527. As a result, the air chamber 51*b* and the pressurizing chamber 527 are kept substantially at the same pressure.

When the ink cartridge 51 supplies the ink to the sub tank 56, the pressurizing pump 53 is activated to supply the air to the air chamber 51*b* through the air tube 54. Accordingly, the ink pack 51*c* is pressed and deformed and the ink flows in the pressure buffering chamber 526 through the plate-like tube 500. As a result, the inner pressure of the pressure buffering chamber 526 increases. However, when the pressurizing pump 53 is activated, the air is supplied to the pressurizing chamber 527 through the air tube 54. Accordingly, the inner pressure of the pressurizing chamber 527 also increases. As a result, the flexible film 526*b* is not bent away from the bottom of the staying concave portion 526*a* but becomes substantially parallel to the surface 510*a*.

When the ink cartridge 51 is detached, the air tube 54 is opened to the atmosphere through the connection plug 54*b*. Accordingly, the pressurizing chamber 527 is opened to the atmosphere and the inner pressure thereof is lowered to be equal to the atmospheric pressure. On the other hand, since the inner pressure of the flow channels (the flexible tube 55, the plate-like tube 500, and the like) through which the ink flows is high before detaching the ink cartridge 51, causing the flexible film 526*b* to be bent away from the bottom of the concave staying portion 526*a* due to the pressure difference between the flow channel and the pressurizing chamber 527 opened to the atmosphere at the time of detaching the ink cartridge 51. Accordingly, it is possible to prevent the ink from being extruded from the ink supply needle 52*b*.

Figure 10:
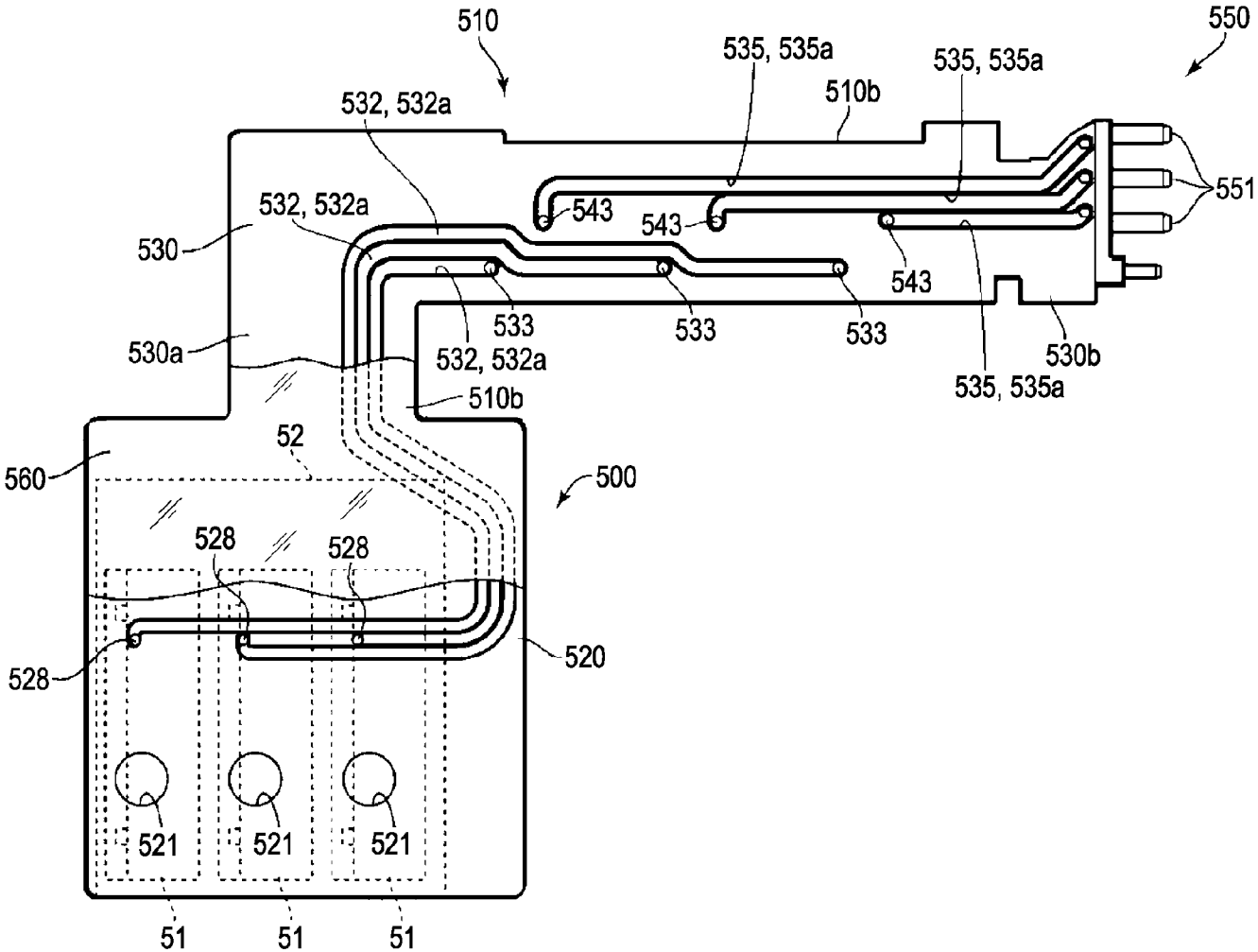
FIG. 10 is a rear view illustrating a configuration of the plate-like tube according to the second embodiment of the invention.

One end of a through hole 528 is disposed in the staying concave portion 526*a*. The through hole 528 communicates with the staying concave portion 526*a* on the surface 510*a* and communicates with a first groove 532*a* (hereinafter, the first groove 532*a* of this embodiment corresponds to the second groove 532*a* of the first embodiment and the first ink channel 532 of this embodiment corresponds to the second ink channel 532 of the first embodiment) on the rear surface 510*b* (as shown in FIG. 10). The first groove 532*a* constitutes the first ink channel 532 which is formed by attaching the film 560 to the rear surface 510*b*. As shown in FIG. 10, the first groove portion 532*a* extends from the holder attaching portion 520 to the channel forming portion 530. The first groove 532*a* is formed in the vertical portion 530*a* and the horizontal portion 530*b* of the channel forming portion 530.

Ink Supply Operation

An ink supply operation of the printer 10 according to the second embodiment will be described now. Before supplying the ink, a user correctly attaches the ink cartridge 51 to the cartridge holder 52 and the ink can be thus supplied. When the pressurizing pump 53 is activated in accordance with an instruction from the controller 70, the air is supplied to the air chamber 51*b* through the air tube 54. Since the communicating hole 54*a* is formed in the air tube 54, a part of the air is supplied to the pressurizing chamber 527 through the communicating hole 54*a*.

As described above, since the air is supplied to the air chamber 51*b*, the ink pack 51*c* is pressed and deformed with the supply of the air. The ink flows in the ink outflow hole 522 through the ink supply port 51*d* and the ink supply needle 52*b*. Thereafter, the ink is supplied to the sub tank 56 through the pressure buffering chamber 526, the first ink channel 532, the choke valve chamber 541, the second ink channel 535, the tube connecting portion 550, and the flexible tube 55.

As described above, when the supply of ink to the flow channel up to the sub tank 56 is started, the inside pressure of the flow channel is higher than the atmospheric pressure. Accordingly, the flexible film 526*b* constituting the pressure buffering chamber 526 tends to bend away from the bottom of the concave staying portion 526*a*, while the inside pressure of the pressurizing chamber 527 and the inner pressure of the flow channel vary with the activation of the same pressurizing pump 53 and thus have a relation to each other (which is substantially the same state in this embodiment). Accordingly, the flexible film 526*b* becomes substantially parallel to the surface 510*a* as shown in FIG. 11, when the pressurizing pump 53 is being activated.

For example, when a user is notified by a screen display of the computer 80 that the ink is running short, the user may replace the ink cartridge 51. First, the ink cartridge 51 is detached by the user. At this time, the ink supply port 51*d* is disconnected from the ink supply needle 52*b* and the tube engaging portion 51*e* is disengaged (disconnected) from the connection plug 54*b*.

In the configurations known in the art, the inner pressure of the flow channels (the flexible tube 55, the plate-like tube 500, and the like) is higher than the atmospheric pressure because of the activation of the pressurizing pump 53 which operates before the ink cartridge 51 is detached. Accordingly, when the ink cartridge 51 is detached, the elastic force resulting from the swelling of the flexible tube 55 due to the inside pressure thereof is released and the flexible tube 55 contracts, whereby the ink tends to be extruded from the ink supply needle 52*b*.

However, in this embodiment, when the ink cartridge 51 is detached, the air tube 54 is opened to the atmosphere through the connection plug 54*b*. Accordingly, the pressurizing chamber 527 is opened to the atmosphere and thus the inner pressure is equalized to the atmospheric pressure. Therefore, as shown in FIG. 12, the ink flowing to the ink supply needle 52*b* bends the flexible film 526*b* of the pressure buffering chamber 526 away the bottom of the concave staying portion 526*a* due to the difference between the inner pressure of the pressurizing chamber 527 and the inner pressure of the pressure buffering chamber 526. At this time, the flexible film 526*b* can be bent by the inner pressure (liquid pressure) of the flow channel. Accordingly, the volume of the pressure buffering chamber 526 increases and the ink is not extruded from the ink supply needle 52*b* with a predetermined force but is absorbed by the increasing volume.

Advantages

In the above-mentioned configuration, the pressure buffering chamber 526 is disposed in the middle of the flow channel, allowing the ink to flow through the channel. When the ink is supplied, the inner pressure of the pressurizing chamber 527 is pressurized. However, when the ink cartridge 51 is detached, the pressurizing chamber 527 is opened to the atmosphere. Accordingly, the inner volume of the pressure buffering chamber 526 increases due to the release of the pressurized state at the time of detaching the ink cartridge 51. Therefore, even when the flow channel is pressurized and the ink tends to be extruded from the ink supply needle 52*b*, it is possible to prevent the extrusion of ink with the increase of the inner volume. As a result, it is possible to prevent the ink from being extruded and contaminating the cartridge holder 52 or the printing object P when the ink cartridge 51 is detached. Since it is possible to prevent the extrusion of ink, it is not necessary to provide a portion receiving the extruded ink, thereby suppressing the increase in cost.

In this embodiment, the flexible film 526*a* is bent close to and away from the bottom of the concave staying portion 526*a* depending on the air pressure. Accordingly, at the time of detaching the ink cartridge 51 from the cartridge holder 52, the inner volume of the pressure buffering chamber 526 can easily be increased due to the bending of the flexible film 526*b*, thereby absorbing the pressure of the ink (the liquid pressure).

In this embodiment, the pressurizing chamber 527 is formed by the case body 527*a* and the air supplied from the pressurizing pump 53 is introduced into the pressurizing chamber 527 through the communicating hole 54*a*. Accordingly, the inside of the pressurizing chamber 527 can be pressurized and the flexible film 526*b* can be kept in a state where it is pushed from the pressurizing chamber 527 when the ink is supplied. In other words, at the time of detaching the ink cartridge 51 the pressurized state of the pressurizing chamber 527 is released, so as to not to keep t the flexible film 526*b* pressurized, and the flexible film 526*b* is bent to protrude into the pressurizing chamber 527. Accordingly, the inner volume of the pressure buffering chamber 526 increases, thereby preventing the extrusion of ink.

The concave staying portion 526*a* is disposed in the hard tube plate 510 and the flexible film 526*b* is formed of a thin film member. Accordingly, the flexible film 526*b* can easily bend to correspond to the pressure of the ink and the pressure of the pressurizing chamber 527. Since the flexible film 526*b* can be easily bent, the elastic force corresponding to the bending of the flexible film 526*b* does not act toward the pressure buffering chamber 526. Accordingly, when the flexible film 526*b* is bent toward the pressurizing chamber 527, it is possible to prevent the increase in pressure of the pressure buffering chamber 526.

The concave staying portion 526*a* is disposed in the plate-like tube 500 is located upstream the flexible tube 55. Since the flexible tube 55 has flexibility, the flexible tube is bent so as to swell with the pressurization of the pressurizing pump 53 and the like. Accordingly, at the time of detaching the ink cartridge 51, the flexible tube 55 tends to contract due to the release of the pressurized state and the ink flows upstream with the contraction. However, since the concave staying portion 526*a* (pressure buffering chamber 526) is disposed upstream the flexible tube 55, the pressure of the ink (liquid pressure) can be absorbed. Accordingly, it is possible to prevent the ink from being extruded to contaminate the cartridge holder 52 or the printing object P at the time of detaching the ink cartridge 51.

The pressurizing chamber 527 and the pressure buffering chamber 526 of the two embodiments of the present invention have substantially the same pressure when the pressurizing pump 53 is activated. Accordingly, the flexible film 526*b* is not bent toward the pressurizing chamber 527 but is kept in an equilibrium state.

Modified Examples

Although the invention has been described with reference to the first and second embodiments, the invention is not limited to the embodiments, but may be modified in various forms, including those described below.

In the above-mentioned embodiments, the pressure buffering chambers 525 and 526 are disposed in the plate-like tube 500. However, the pressure buffering chamber 525 or 526 need not be disposed in the plate-like tube 500, but may be attached to and detached from the ink outflow hole 522 of the plate-like tube 500 with the ink supply needle 52*b*. In this case, a bag-shaped member of vinyl or the like corresponding to the flexible member or volume varying member may be used as the pressure buffering chamber 525 or 526.

In the first embodiment, the push mechanism 90 comprises a push rod 91 and a coil spring 92. However, the push member is not limited to the push mechanism 90. For example, the configuration that the push portion 91B pushes the flexible film 525*b* with the attachment of the ink cartridge 51 need not be employed, but a configuration that the push portion 91B pushes the flexible film 525*b* by the use of an actuator such as a motor or an air pressure and that the push rod 91B releases the push to the flexible film 525*b* in synchronization with the detachment of the ink cartridge 51 may be employed.

In the first embodiment, the coil spring 92 of the push mechanism 90 need not be provided but may be omitted. For example, a rubber bush having a side sectional shape of T may be used instead of the push mechanism 90.

In the first embodiment, the flexible film 525*b* is used as the flexible member. However, a plate member having a thin plate shape may be used as the flexible member and the plate which has a non-spring force when it is moved away from the bottom of the liquid staying portion 525*a* in the non-pressed state. In this case, in the state where the plate member is not pushed by the push rod 91, the plate member is satisfactorily apart from the bottom of the liquid staying portion 525*a*. Accordingly, it is possible to enhance the volume of the pressure buffering chamber 525 at once, thereby satisfactorily preventing the extrusion of ink.

In the second embodiment, the case body 527*a*, the air tube 54, and the pressurizing pump 53 are used as the pressurizing member. However, the pressuring member is not limited to them. For example, a bag-shaped member formed of vinyl and communicating with the air tube 54 may be used instead of the case body 527*a* and the pressure buffering chamber 526 may be covered with the bag-shaped member. The inside of the pressurizing chamber 527 may be pressurized by the use of a pump different from the pressurizing pump 53.

The second embodiment employs the configuration that a part of the air flowing through the air tube 54 is made to flow in the pressurizing chamber 527 through the communicating hole 54*a*. However, all the air supplied from the air tube 54 may be introduced into the pressurizing chamber 527. In this case, for example two air tubes may be used. Of two air tubes, an end of a first air tube is connected to the pressurizing pump 53 and the other end of the first air tube is connected to the pressurizing chamber 527. An end of a second air tube is connected to the pressurizing chamber 527 and the other end of the second air tube is provided with the connection plug 54*b* engaging with the tube engaging portion 51*e*.

In this way, the pressure from the pressurizing pump 53 rapidly reaches the pressurizing chamber 527 and the air in the pressurizing chamber 527 opened to the atmosphere is more rapidly discharged from the other end of the second air tube, thereby more rapidly opening the pressurizing chamber 527 to the atmosphere.

The printer 10 according to the above-mentioned embodiments may be a part of a complex machine having multiple functions, including a scanner function, a copier function, and the like, other than the printer function. Moreover, the liquid ejecting apparatus is not limited to a printer 10. Other examples of the liquid ejecting apparatus other than the printer 10 includes an apparatus for ejecting a liquid, which is used for manufacturing a liquid crystal display, an EL display, and the like. The liquid may be a liquid other than the ink. For example, coloring materials or electrode materials may be used in a liquid ejecting apparatus used for manufacturing a liquid crystal display or an EL display.

What is claimed is:

1. A liquid ejecting apparatus comprising:

an ejection head capable of ejecting a liquid onto an ejection object;

a liquid source including a liquid container capable of containing the liquid;

a flow channel capable of allowing the liquid to flow form the liquid source to the ejection head; and a pressure buffer disposed in the flow channel which is capable of buffering any variation in pressure in the liquid in the flow channel when the liquid container is detached from the liquid source, wherein the pressure buffer comprises:

a volume varying member disposed in the flow channel capable of allowing the liquid to flow therein and varying the volume of the varying member in response to an initiation from a push member;

the push member capable of initiating the volume varying member to vary the volume thereof and capable of initiating a release in the variation of volume in the volume varying member when the liquid container is detached from the attachment section.

2. The liquid ejecting apparatus according to claim 1, wherein the volume varying member comprises a liquid staying portion that is disposed to communicate with the flow channel that is capable of retaining the liquid; and a flexible member capable being pushed by the push member and covering the liquid staying portion when it is deformed due to the varied pressure of the liquid so as to form a flexible pressure buffering chamber that is capable of bending when the flexible member is pushed by the push member.

3. The liquid ejecting apparatus according to claim 1, wherein the push member is disposed in the attachment section and comprises:

a push rod inserted through an insertion hole of the attachment section comprising:

a rod portion disposed through the insertion hole;

a push portion having a diameter larger than that of the rod portion which is capable of coming into contact with the flexible member; and a bearing portion having a diameter larger than that of the rod portion which is capable of coming into contact with the liquid container when the liquid container is attached to the attachment section; and a moving member capable of giving a moving force to the push rod which causes the push portion to contact the flexible member and cause the flexible member bend to expand and contract the volume of the flexible pressure buffering chamber.

4. A liquid ejecting apparatus comprising:

an ejection head capable of ejecting a liquid to an ejection object;

a liquid source including a liquid container capable of containing the liquid and attaching to and detaching from an attachment section;

a flow channel communicating with the liquid container capable of allowing the liquid to flow toward the ejection head;

a volume varying member disposed in the flow channel capable of allowing the liquid to flow therein and varying the volume of the varying member in response to a initiation from a push member; and a push member capable of initiating the volume varying member to vary the volume thereof and capable of initiating a release in the variation of volume in the volume varying member when the liquid container is detached from the attachment section.

5. The liquid ejecting apparatus according to claim 4, wherein the volume varying member comprises:

a liquid staying portion that is disposed to communicate with the flow channel that is capable of retaining the liquid; and a flexible member capable being pushed by the push member and covering the liquid staying portion when it is deformed due to the varied pressure of the liquid so as to form a flexible pressure buffering chamber that is capable of bending when the flexible member is pushed by the push member.

6. The liquid ejecting apparatus according to claim 5, wherein the push member is disposed in the attachment section and comprises:

a push rod inserted through an insertion hole of the attachment section comprising:

a rod portion disposed through the insertion hole;

a push portion having a diameter larger than that of the rod portion which is capable of coming into contact with the flexible member; and a bearing portion having a diameter larger than that of the rod portion which is capable of coming into contact with the liquid container when the liquid container is attached to the attachment section; and a moving member capable of giving a moving force to the push rod which causes the push portion to contact the flexible member and cause the flexible member bend to expand and contract the volume of the flexible pressure buffering chamber.

7. The liquid ejecting apparatus according to claim 5, wherein the liquid staying portion is formed of a hard resin material, and wherein the flexible member is a thin film member.

8. The liquid ejecting apparatus according to claim 5, wherein the flow channel comprises:

a flexible tube that is capable of moving in association with the ejection head which allows the liquid to flow the tube; and a plate-like tube that is connected to the flexible tube that is disposed further upstream in the liquid supply direction than the flexible tube, and wherein the liquid staying portion is disposed in the plate-like tube.

9. A liquid supply method of supplying a liquid from a liquid container to an ejection head through a flow channel, the liquid container being freely attached and detached from a liquid source, the method comprising:

allowing liquid to flow through a flow channel which includes volume varying member which is capable of varying the volume of the volume in the area where the liquid flows;

compressing the liquid flowing in the flow channel using the volume varying member when the liquid container is attached to the attachment section, wherein the volume varying member is disposed in the flow channel and is capable of allowing the liquid to flow therein and varying the volume of the volume varying member in response to an initiation from a push member; and decompressing the liquid in the flow channel and liquid container when the liquid container is detached from the attachment section using the push member capable of initiating the volume varying member to vary the volume thereof and capable of initiating a release in the variation of volume in the volume varying member when the liquid container is detached from the attachment section.

10. The method of claim 9, wherein the liquid flowing in the flow channel is compressed by a flexible member capable being pushed by a push member.

* * * * *